US007320616B1

(12) United States Patent
Legrady et al.

(10) Patent No.: US 7,320,616 B1
(45) Date of Patent: Jan. 22, 2008

(54) INSULATION DISPLACEMENT CONNECTOR ASSEMBLY AND SYSTEM ADAPTED FOR SURFACE MOUNTING ON PRINTED CIRCUIT BOARD AND METHOD OF USING SAME

(75) Inventors: Janos Legrady, Putnam Valley, NY (US); Ronald Fredriks, Pine Plains, NY (US); Raffaele Tarulli, Irvington, NY (US)

(73) Assignee: Zierick Manufacturing Corp., Mount Kisco, NY (US)

( * ) Notice: Subject to any disclaimer, the term of this patent is extended or adjusted under 35 U.S.C. 154(b) by 0 days.

(21) Appl. No.: 11/598,247

(22) Filed: Nov. 10, 2006

(51) Int. Cl.
*H01R 4/24* (2006.01)
*H01R 4/26* (2006.01)
*H01R 11/20* (2006.01)

(52) U.S. Cl. ..... 439/404; 439/41; 439/425

(58) Field of Classification Search ..... 439/404, 439/41, 42, 417, 425, 395, 393
See application file for complete search history.

(56) References Cited

U.S. PATENT DOCUMENTS 4,295,704 A * 10/1981 Narozny et al. ..... 439/406
4,403,820 A * 9/1983 Rich ..... 439/394
4,826,449 A * 5/1989 Debortoli et al. ..... 439/411
4,891,018 A * 1/1990 Afflerbaugh et al. ..... 439/402
5,513,075 A * 4/1996 Capper et al. ..... 361/773
5,551,889 A * 9/1996 Kozel et al. ..... 439/404
5,605,403 A 2/1997 Vegeais
5,632,629 A * 5/1997 Legrady ..... 439/78
5,667,402 A * 9/1997 Denovich et al. ..... 439/409
5,730,608 A 3/1998 Legrady
6,050,845 A * 4/2000 Smalley et al. ..... 439/417
6,086,407 A * 7/2000 Daoud ..... 439/405

* cited by examiner

*Primary Examiner*—Hae Moon Hyeon
(74) *Attorney, Agent, or Firm*—Myron Greenspan Lackenbach Siegel LLP

(57) ABSTRACT

There is provided an insulation displacement connector (IDC) assembly having a main body defining at least one wire channel. The main body has at least one substantially flat surface to which a vacuum nozzle can be affixed in order to pickup the IDC assembly. The IDC assembly has at least one contact member with a piercing, cutting or slicing end that is slideably disposed within the main body, and a mounting end that extends from the main body. The mounting end of the contact is attached to a printed circuit board. An insulated conductor, such as wire, cable, and/or ribbon, can be quickly and easily inserted in the channel without being pierced by the piercing end of the contact. When a user pushes down on the IDC, the contact slides into the channel and pierces the insulated conductor.

20 Claims, 5 Drawing Sheets

30
W'
W
L 10
14
16
22
20
3
3
30
12
18

38'
14
26
30
18

INSULATION DISPLACEMENT CONNECTOR ASSEMBLY AND SYSTEM ADAPTED FOR SURFACE MOUNTING ON PRINTED CIRCUIT BOARD AND METHOD OF USING SAME

BACKGROUND OF THE INVENTION

1. Field of the Invention

This invention generally relates to electrical connectors and, in particular, to insulation displacement connectors for surfaces mounted on a printed circuit board (PCB).

2. Description of the Related Art

An insulation displacement connector (IDC) forms a connection with an insulated conductor, such as a wire, by using a contact that can pierce the insulation to make contact with and connect to the conductor. IDCs are used extensively in the telecommunications industry because they can very quickly terminate a large number of wires. For the same reason, IDCs are now increasingly used on printed circuit boards (PCBs).

Insulation displacement connectors have become popular because they are highly economical and a cost-effective method for performing wire terminations. No wire or cable preparation is required. IDCs are designed to reduce wire termination cost by elimination the need to remove the insulation from the wire before terminating it. When a wire is inserted into the IDC slot, the piercing contacts cut and displace the wire insulation and pierce it and make contact with the conductor wires surrounded by the insulation.

Many designs for IDCs are known in the art. However, these known IDCs are unsuitable for use with surface mounting technology (SMT). SMT generally requires that an electrical contact be compact in size and light in weight and have a small footprint. The electrical contact must also be heat resistant and compatible with common soldering techniques used in SMT. In addition, since the most common pickup mechanism is a vacuum nozzle of a pick-and-place machine, it is desirable that electrical contacts for surface mounting have at least on suitable flat surface to which a vacuum nozzle can abut against and apply a sufficient vacuum for effective pickup.

SUMMARY OF THE INVENTION

It is an object of the present invention to provide an insulation displacement connector for surface mounting on a printed circuit board using an automatic pick-and-place machine.

It is also an object of the present invention to provide such an insulation displacement connector that is compact in size with a small footprint for surface mounting on a printed circuit board.

It is another object of the present invention to provide such an insulation displacement connector that is light in weight for surface mounting on a printed circuit board.

It is a further object of the present invention to provide such an insulation displacement connector that is heat resistant for surface mounting on a printed circuit board.

It is yet another object of the present invention to provide such an insulation displacement connector for surface mounting on a printed circuit board that is compatible with common soldering techniques.

It is an additional object of the present invention to provide such an insulation displacement connector for surface mounting on a printed circuit board that has at least one sufficiently large, flat surface to which a vacuum nozzle can affix itself.

It is still another object of the present invention to provide an insulation displacement connector that can make a connection with insulated multiple fine wire conductors in a short time with minimal labor.

These and other objects are achieved by an insulation displacement connector (IDC) assembly according to the present invention. The IDC assembly has a main body defining at least one wire channel. In addition, the main body has at least one substantially flat surface to which a vacuum nozzle may be affixed in order to pick up the IDC assembly. The IDC assembly has at least one contact member with a piercing, cutting or slicing end that is slideably disposed within the main body, and a mounting end that extends from the main body. The mounting end of the contact is attached to a printed circuit board. An insulated conductor, such as a wire, cable and/or ribbon, can be quickly and easily inserted in the channel without being pierced by the piercing end of the contact. When a user pushes down on the IDC, the contact slides into the channel and pierces the insulated conductor.

In a presently preferred embodiment, the IDC comprises a surface mount IDC connector for attaching wires to a printed circuit board, including a housing having a number of generally parallel wire-receiving channels at least equal to the number of wires to be connected and generally defining, when the connector is mounted on a printed circuit board (PCB), a plane substantially parallel to the surface of the PCB on which the connector is mounted, said wire receiving channels being dimensioned to receive the wires with little clearance to thereby generally fix the physical positions of the wires against lateral or transverse shifting. Said housing further includes a number of slots corresponding to the number of said channels, each slot being substantially normal to said plane and aligned with and communicating with an associated channel. A plurality of piercing blade assemblies are provided, one received in each of said slots, each piercing blade assembly including at least one piercing blade receivable into a slot for movement through a slot and being at least partially receivable within an associated channel, said piercing blades having a length greater than the dimension of said slots in said normal direction and including a soldering portion positioned beyond said housing when said piercing blades are fully moved into said channels, whereby insertion of said piercing blades through the insulation of wires within said channels pierces the wires while leaving said soldering portions exposed outside said housing for soldering to a PCB.

BRIEF DESCRIPTION OF THE DRAWINGS

Other objects and features of the present invention may become clear from the following description taken in conjunction with the preferred embodiments thereof with reference to the accompanying drawings, in which.

DETAILED DESCRIPTION OF THE PREFERRED EMBODIMENTS

Figures 1, 2, 3, 4:
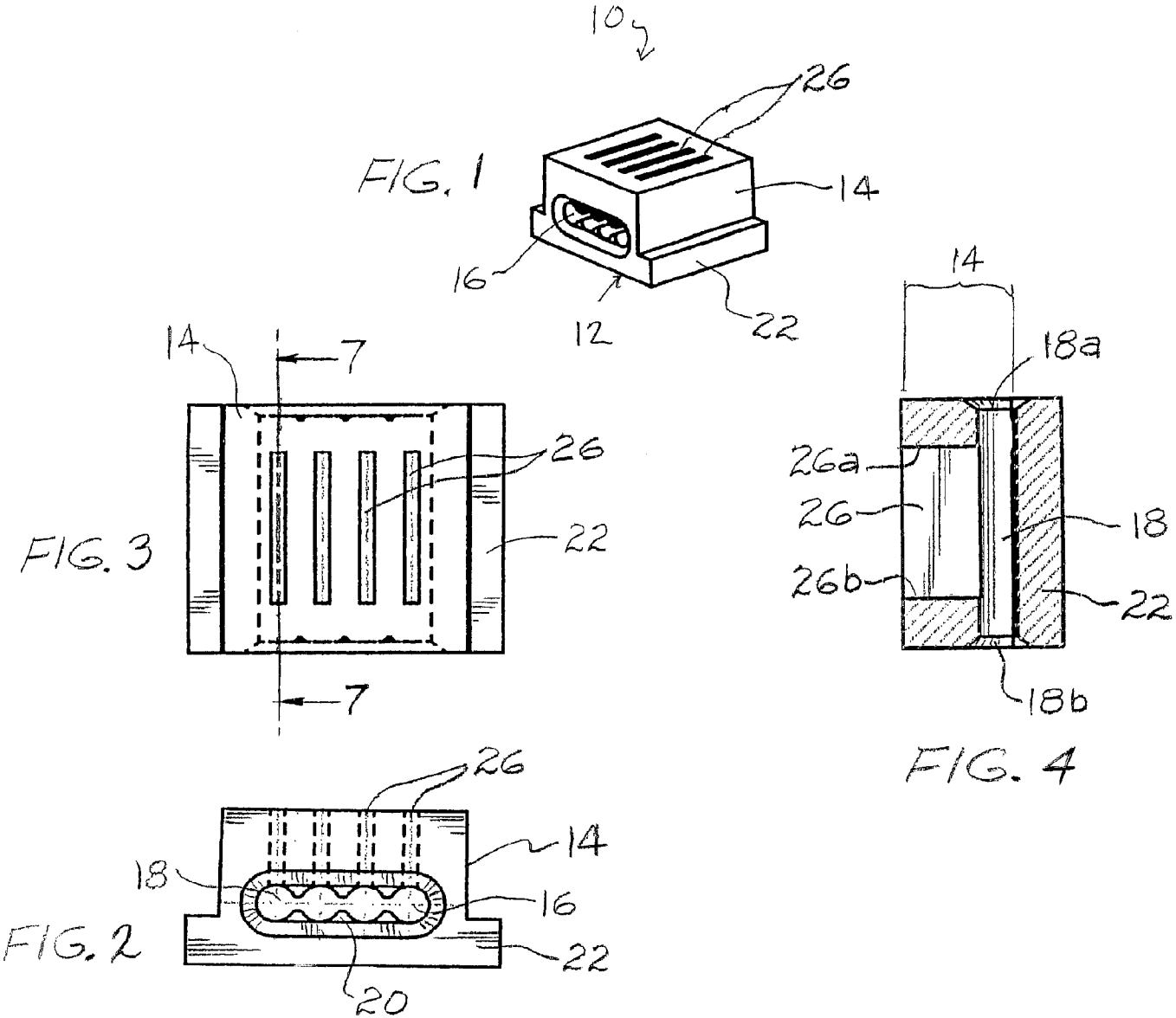
FIG. 1 is a perspective view of an insulation displacement connector block according to the present invention.
FIG. 2 is a front elevational view of the insulation displacement connector housing block of FIG. 1.
FIG. 3 is a bottom plan view of the insulation displacement connector block of FIG. 1.
FIG. 4 is a cross sectional view of the block shown in FIG. 3, taken along line 1-4.
Figure 5:
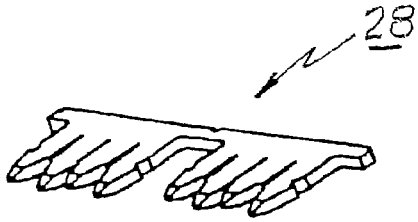
FIG. 5 is a perspective view of a piercing blade assembly for use with the block shown in FIGS. 1-4.
Figure 12:
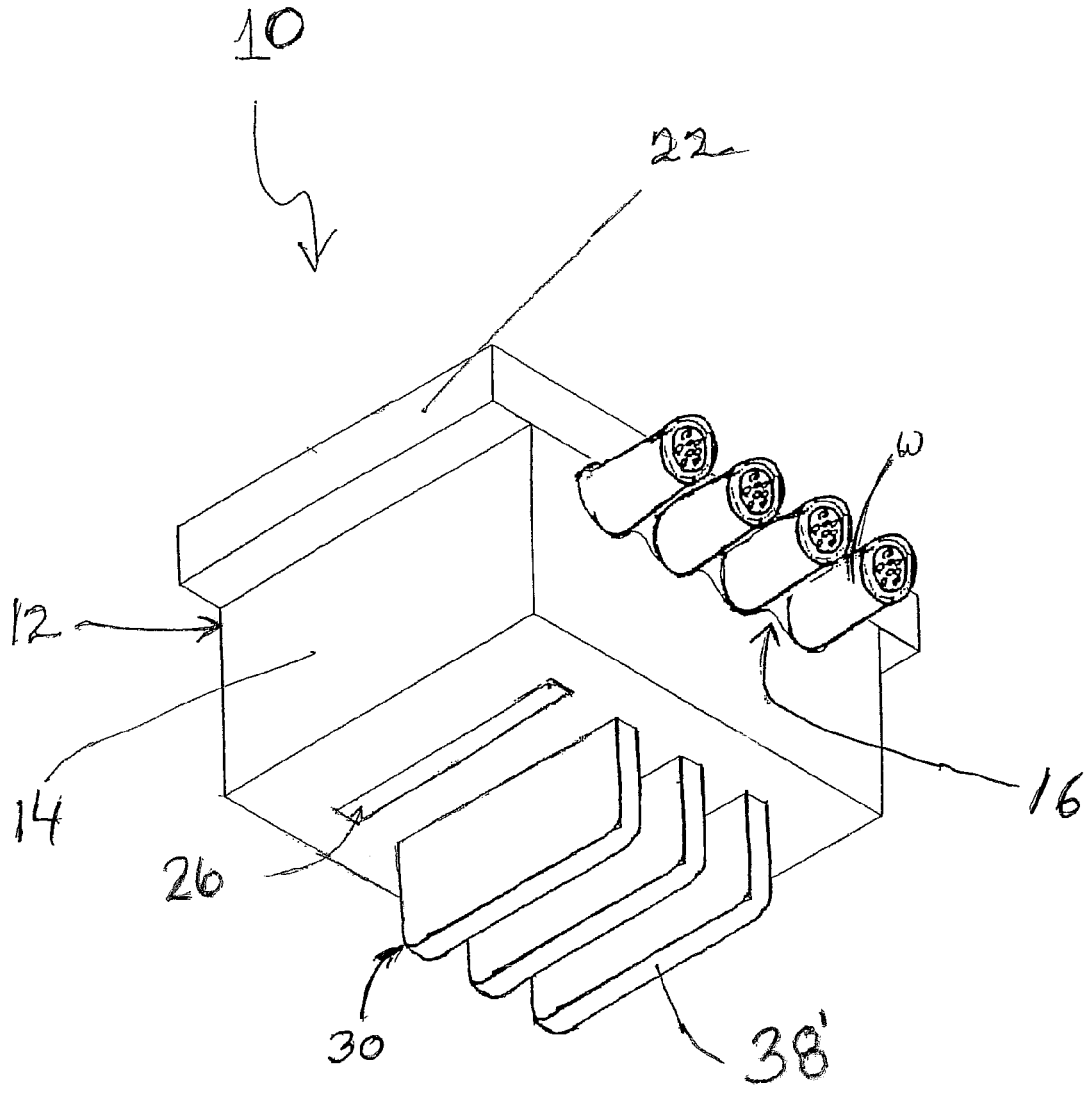
FIG. 12 is a perspective view of the block shown in FIG. 10 with conductors inserted into a plurality of the wire receiving channels.

Referring now specifically to the attached figures, in which the same or similar parts will be designated by the same reference numerals throughout, and first referring to FIGS. 1 and 12, an insulation displacement connector (IDC) assembly is generally designated by the reference numeral 10.

The IDC connector assembly 10 is especially suitable for terminating one or a number of fine wires to a surface mount (SM) IDC connector.

The IDC connector assembly 10 includes a housing block 12 which is typically formed or molded from a suitable plastic material, as will be discussed. The housing block or housing has a generally rectangular receptacle 14 in which there is formed a wire-receiving opening 16. When the IDC connector assembly 10 is mounted on a printed circuit board (PCB) the wire-receiving opening 16 is generally parallel to the mounting surface on the PCB. While the wire-receiving opening may be closed at one end, so that wires can only be received or inserted through the other end, in the presently preferred embodiment, the wire-receiving opening 16 is a through opening open at both ends of the receptacle 14.

The wire-receiving opening 16 is configured to create one or more generally parallel wire-receiving channels 18 the number of which is at least equal to the number of wires to the terminated or connected to the housing block 12. Referring to FIG. 4, for example, each wire-receiving channel 18 has opposing openings 18*a*, 18*b* through which wires to be terminated can be inserted. The wire-receiving channels 18 are dimensioned to receive wires with little clearance to thereby generally fix the physical positions of the wires against lateral or transverse shifting, as suggested in FIG. 12. Such alignment or fixing of the wires is facilitated by means of a plurality of internal alignment ridges 20 which help to position and maintain the wires against lateral shifting, as suggested in FIGS. 2, 10, 12 and 13.

To one side of the receptacle 14 there is provided a pressure plate or shoulder 22 which exhibits an exposed flat pickup/pressure surface 22'. As suggested in FIG. 13, the flat pickup surface 22' is suitable for cooperation with a vacuum nozzle (not shown) of a pick-and-place machine which can cooperate with the flat surface 22' for picking up and placement of the housing block 12 at a suitable location on a PCB.

At the opposing surface from the flat pickup surface 22' there are provided a plurality of piercing blade slots 26 the number of which corresponds to the number of wire-receiving channels 18. Each slot 26 is substantially normal to the plane defined by the wire-receiving opening 16 and aligned to communicate with an associated channel 18. As best shown in FIGS. 2, 4, 9 and 10, the slots 26 have lateral guide edges 26*a*, 26*b* and extend to and communicate with the wire-receiving opening 16.

One or more piercing blade assemblies 30 are provided one receivable in each of the slots 26. Each piercing blade assembly includes at least one piercing blade 38 receivable into a slot 26 for movement through a slot and being at least partially receivable within an associated wire-receiving channel 18. The piercing blades 38 have a length greater than the dimension of the slots 26 in the normal direction and include a soldering portion including an edge surface 38' positioned beyond the receptacle 14 when the piercing blades are fully moved into or inserted into the wire-receiving channels 18. It will be evident, therefore, that the insertion of the piercing blades 38 into the channels pierces or displaces the insulation of wires that are within the wire-receiving channels 18 while leaving the soldering edges or surfaces 38' exposed outside of the housing block 12 or receptacle 14 for soldering to a PCB, as shown and suggested in FIGS. 12 and 13.

Figure 6:
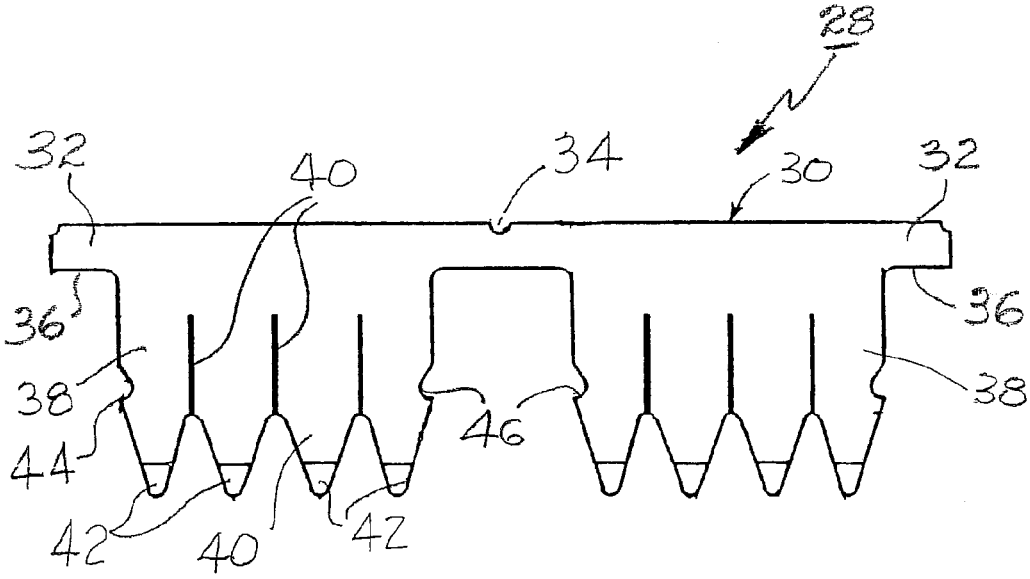
FIG. 6 is an enlarged side elevational view of the blade assembly shown in FIG. 5.

The piercing blade assemblies 30 may be produced as a continuous strip 28, as shown in FIG. 6, successive piercing blade assemblies being connected to each other by a connecting strip or tab 32 which also serves as a stop portion for preventing excessive insertion of the piercing blades into the receptacle 14. A notch 34 is preferably provided centrally between each connecting strip 32 to facilitate separation of the piercing blade assemblies from each other. The inner edge surface 36 of each stop portion engages the receptacle 14 to prevent further penetration of the piercing blade assemblies 30 into the block once sufficient penetration has taken place to effectively pierce and displace the insulation to make contact with the internal wires of the conductors.

Figure 7:
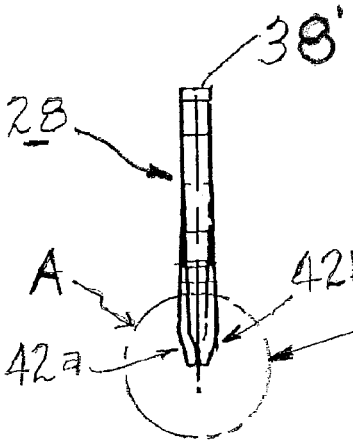
FIG. 7 is an end elevational of the blade assembly shown in FIG. 6.
Figure 8:
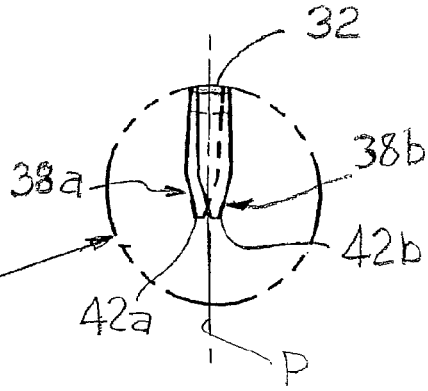
FIG. 8 is an enlarged view of the piercing tips of the blade assembly shown in the detail A in FIG. 7.

Referring to FIGS. 7 and 8, each piercing blade assembly 30 preferably includes a plurality of substantially co-planar piercing blades 38 that extend along the lengths of the wire-receiving channels 18. Successive ones of the blades 38 are preferably slightly offset to opposite sides of a plane defined by the co-planar piercing blades to ensure that the captured conductor and its insulation sheath are not urged to one side or the other during the penetration of the blades but, instead, the offset blades have the effect or tendency to apply forces on the conductor that maintains its position centrally within the channels to ensure reliable penetration and electrical contact with the inner conductive wires.

Figures 9, 10, 11:
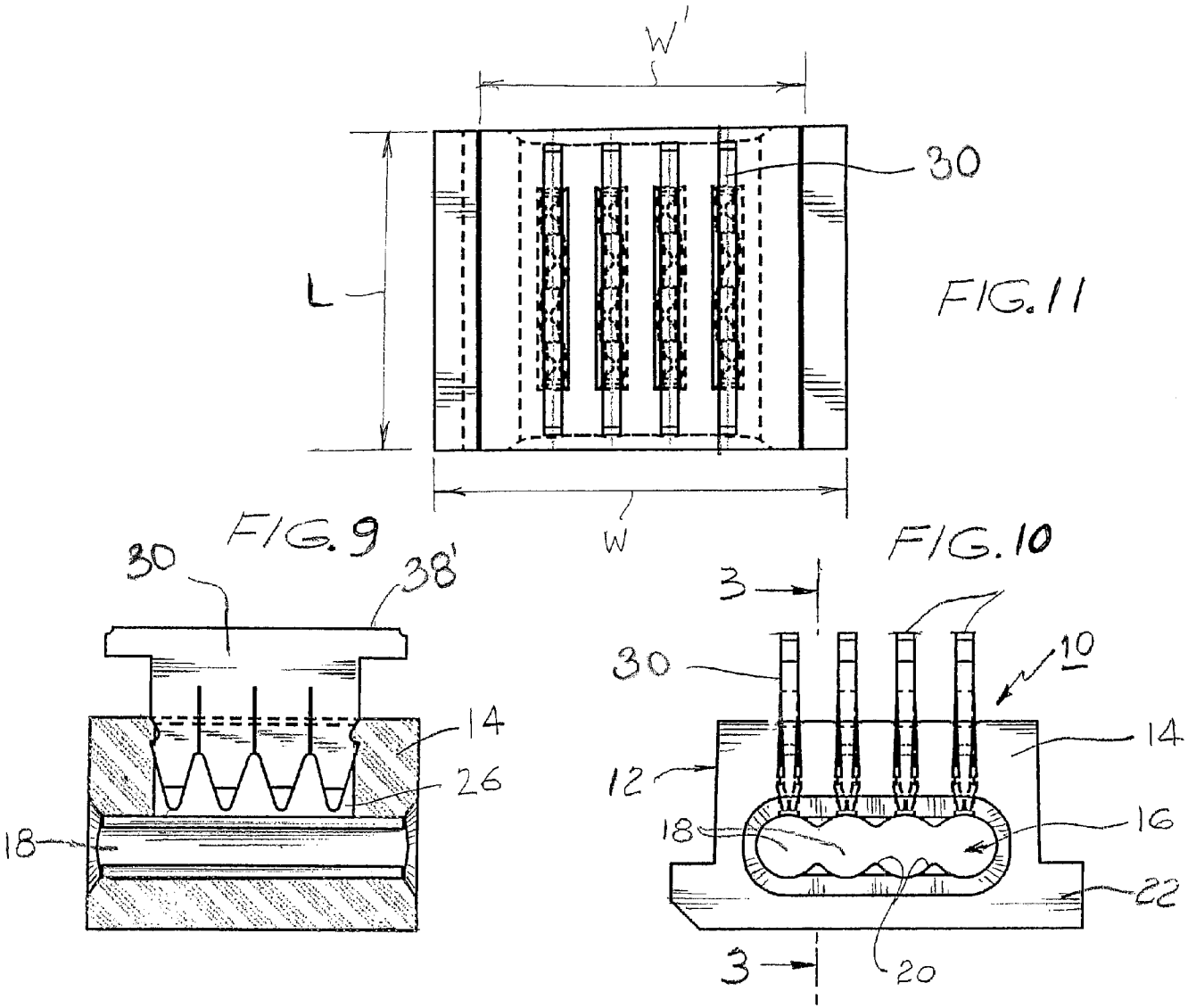
FIG. 9 is similar to FIG. 4 also showing a blade assembly of FIGS. 5-8 at least partially inserted into a slot of the connector block.
FIG. 10 is similar to FIG. 2 shown with four blade assemblies partially inserted into the connector block.
FIG. 11 is similar to FIG. 3 showing the blade assemblies inserted into the slots of the connector block.

In accordance with one feature of the invention, each piercing blade assembly 30 includes a plurality of substantially co-planar piercing blades 38, as aforementioned, that have a dimension substantially corresponding to the dimension of the slots 26 along the direction of the wire-receiving channels 18. Unidirectional material engaging means are preferably provided for engaging a material surface of the slots and permitting the piercing blade assemblies to be urged into the slots while preventing a piercing blade assemblies from being removed from the slots by providing significantly less resistance of movement during insertion then during extraction or removal of the piercing blade assemblies. Referring to FIGS. 6 and 9, the end piercing blades 38, at the beginning and the end of each series of such blades, is provided with laterally protruding portion 44, in the form of a barb or spike, that cooperates with a receiving recess 46 for receiving displaced plastic material of the receptacle 14. The protruding portion 44 points slightly outwardly and upwardly, as viewed in FIG. 6, so that insertion of the piercing blade assembly 30 as in FIG. 9 provides some resistance due to the lateral engagement and resulting friction between the protruding portions 44 and the surfaces at the ends of the slots which make contact therewith. Once some of the plastic material in the slot is removed or displaced it may be received within the receiving recesses 46. While application of a predetermined amount of pressure permits the piercing blade assembly 30 to be inserted into an associated slot 26, removal becomes more difficult if not impossible because of the orientation of the protruding portion 44 since the resulting resistance is significantly greater for removal then for insertion. This ensures that once the piercing blade assembly has been inserted and penetrates the conductor that it remains in its final position and can not inadvertently be removed from an associated slot. Referring to FIG. 11, for example, the width W of the housing block 12 is slightly larger then the width W' of the receptacle 14. This provides a slightly greater surface 22' for application of pressure by a press or other suitable insertion tool.

Figure 13:
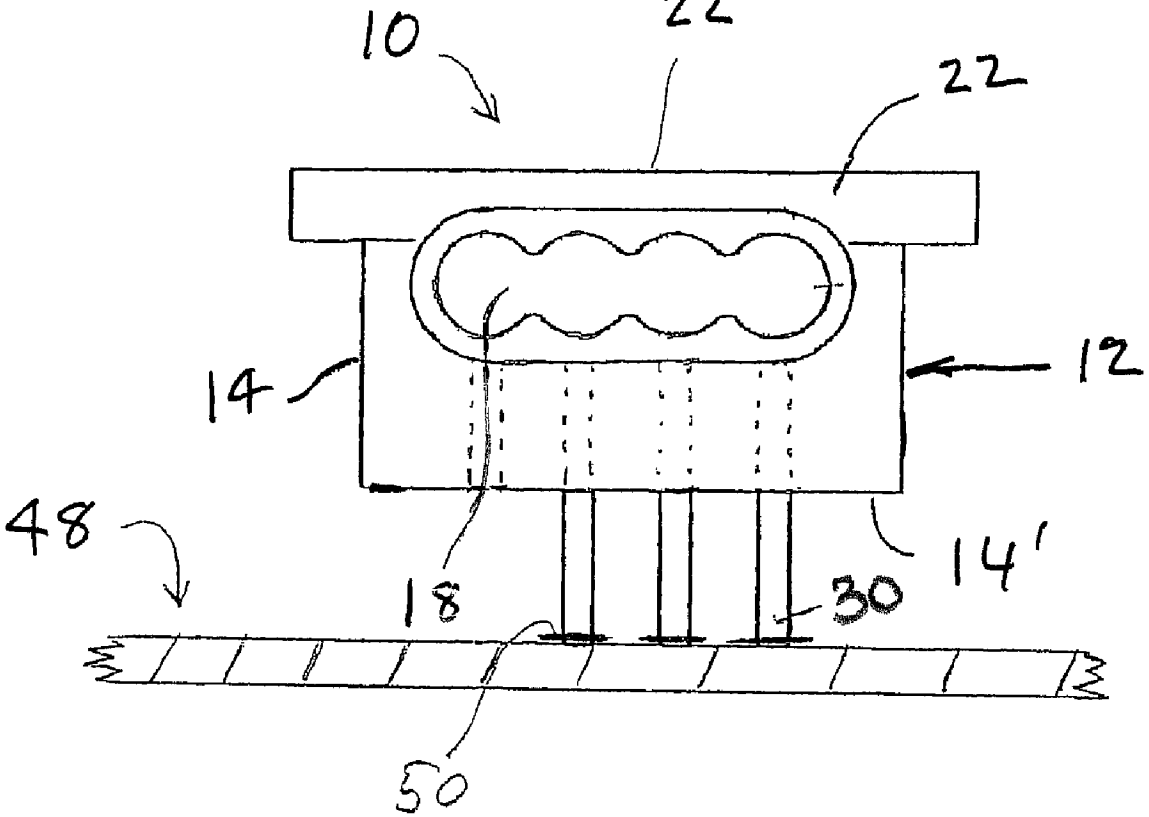
FIG. 13 is similar to FIG. 2 but showing the insulation displacement connector positioned on a PCB for attachment thereto.

Referring to FIG. 13, housing block 12 is adapted to reduce the amount of space occupied by the IDC 10 when it is mounted on a PCB. The block 12 has a width W (FIG. 11) which is a function of the number of slots 26. The block 12 may have any shape depending on the specific application, such as cylindrical or rectilinear. As shown, block 12 is generally rectilinear or rectangular in shape. The length L along the directions of the slots 26 may be about 0.223 inches long. The width W' may be about 0.225 inches wide between the left and the right lateral surfaces.

The block 12 has a shoulder 22 having an exposed flat surface 22' that is relatively broad and flat so that a vacuum pickup nozzle can effectively fasten itself thereto. This is a significant aspect of the present invention because it allows the IDC 10 to be handled by automated pick-and-place machines. The shoulder 22 may have any shape depending on the specific application, such as cylindrical or rectilinear. The shoulder 22 may have a similar or different shape compared to the block 12. As shown, shoulder 22 is generally rectangular in shape.

The surface 22' may be about 0.225 inches in length and about 0.283 in width. The top surface 22' has an area that is preferably larger than the area of the bottom surface 14'. At its tallest point, IDC 10 is about 0.130 inches tall between the top surface 22' and the bottom surface 14'.

The wire channel 18 may be about 0.040 inches to about 0.043 inches in diameter. To facilitate the insertion of a wire into wire channel 18, the entrance portions 18*a* and 18*b* preferably flared outwardly or have a diameter that is slightly larger than the diameter of the remainder of the wire channel 18.

IDC 10 is preferably attached to a PCB using surface mounting technology. Accordingly, IDC 10 is specifically shaped to be releasably held by a vacuum nozzle of an automated pick-and-place machine. As stated above, top surface 22' is preferably broad and flat to facilitate adequate suction from the vacuum nozzle, so that IDC 10 can be picked-up. Alternatively, top surface 22' may have a lip and/or a groove shaped to mate and/or coordinate with the vacuum nozzle. For example, top portion 22 may have a raised portion or tab that extends a short distance into the opening of the vacuum nozzle. Further details of pick-and-place machines, in particular, and surface mounting technology, in general, are described in U.S. Pat. Nos. 5,605,403 and 5,730,608, which are incorporated herein by reference in their entirety. To mount IDC 10 on a PCB, vacuum nozzle of an automated pick-and-place machine is releasably affixed to top side 22'. IDC 10 is placed on the PCB in such a manner that the edge surfaces 24' of the contacts or blades 38 are positioned on a PCB land or pad. Reflow soldering melts the metal of the PCT land and subsequent cooling of the melted metal forms a bond between blade 38 and the PCB.

As shown in FIG. 10, the blades 38 initially do not extend into channels 18. In this way, a wire may be relatively easily and quickly inserted into the channels 18 without being impeded by the blades 38. A wire W may be inserted into the channel 18 either before or after IDC 10 is mounted on a PCB. Preferably, the IDC 10 is mounted on a PCB before a wire is inserted into channels 18. Once IDC 10 is mounted on a PCB and a wire is inserted into a channel 18, a user or suitable tool may push down on IDC 10, which forces the block 12 to slide along relative to the blades 38 within slots 24, whereby the piercing tips 42 of blades 38 extend into channels 18. Thus, the piercing portion or tips 42 of blades 38 are made to pierce or cut the insulation of an insulated wire in the channels 18 and, ultimately, touch the conductive material or metal in the center of the wire, whereby an interconnection is formed between the PCB and the wire. Of course, if non-insulated (e.g., a bare metal wire) is terminated the conducting material or metal will be directed pushed against or into blades 38. The blades 38 may also actually bite or cut into the conducting material or metal in the center of the wire to form a potentially "gasless" connection.

In use, the piercing blade assemblies 30 are at least partially inserted into the associated slots 24 and the IDC connector assembly 10 is positioned on associated lands or pads 50 of a PCB 48 as shown in FIG. 13. Any suitable and conventional soldering technique may be used to secure the edge surfaces 24' to the PCB to affix the housing block 12 as shown. Wires w are then inserted into the wire-receiving channels 18 as suggested in FIG. 12. Once the wires are in place, suitable pressure may be applied to upper surface 22' to urge the entire housing block 12 downwardly in the direction of the PCB 48. In doing so, the piercing blade assemblies 30 are forced to further penetrate into the slots 24 and ultimately into the wire-receiving channels 18 until the piercing tips 42 pierce the wires w and make contact therewith. Thus, by a single application of a suitable downward force on the housing block 12 all of the wires w to be terminated are simultaneously pierced and suitably and reliably contacted. The IDC connector assembly 10 is preferably placed on a PCB 48 and soldered thereto prior to insertion of the wires, this permitting the use of pick-and-place equipment, it is also possible to use the IDC connector assembly in applications that do not involve automated pick-and-place equipment. In some cases, the IDC connector assembly 10 can also be used to insert the wires into the wire-receiving channels 18, causing the piercing blades 24 to pierce the conductors and then the assembly mechanically connected such as by soldering, to a PCB. However, the greatest application is with automated equipment and the assembly is particularly adapted for surface mounting of connector assemblies for terminating fine wire conductors.

While the invention has been shown and described in connection with a preferred form of an embodiment it will be understood that modifications may be made without the departure from the scope or spirit of the invention.

What is claimed is:

1. An electrical connector assembly comprising:

a main body having a wire-receiving channel therethrough for receiving an insulated stranded core wire, at least one generally transverse slot opening at only one side of said main body and extending to said wire-receiving channel an opposite side to said one side being a generally smooth continuous surface; and an electrical contact having a portion slideably received within a slot in said main body and having a wire piercing portion adapted to move into said wire-receiving channel to pierce insulation on a wire extending through said wire-receiving channel and directly connect with strands of a wire inserted within said wire-receiving channel, and a free portion adapted to be surface mounted on a printed circuit board, whereby an interconnection between said wire and printed circuit board is formed after said electrical contact is attached to said printed circuit board and after said wire is inserted within said wire-receiving channel by a user sliding said main body along said electrical contact until said electrical contact extends into said wire-receiving channel and connects with said wire by piercing the insulation and stranded core of the wire.

2. The electrical connector assembly of claim 1, wherein said main body has a top portion continuous surface adapted to be releasably held by a vacuum nozzle of an automated pick-and-place machine.

3. The electrical connector of claim 1, wherein said wire piercing portion of said electrical contact is adapted to pierce the insulation surrounding the wire inserted into said wire-receiving channel and pierce the stranded core.

4. The electrical connector of claim 1, wherein said upper portion of said electrical contact has at least one sub-portion having a substantially pointed shape adapted to pierce insulation surrounding the wire inserted into said wire-receiving channel.

5. The electrical connector of claim 1, wherein said continuous surface of said main body has a surface approximately 0.225 inch long and about 0.223 inch to about 0.283 inch wide.

6. The electrical connector of claim 1, wherein said main body is made with at least one thermoplastic material.

7. The electrical connector of claim 1, wherein said main body and said electrical contact are adapted to substantially withstand the temperature of reflow soldering.

8. The electrical connector of claim 1, wherein said main body has an upper surface and a bottom surface, said upper surface having a larger surface area than said bottom surface.

9. The electrical connector of claim 1, wherein said main body has a front surface, a back surface, and a bottom surface, wherein said wire-receiving channel extends through said main body between said front surface and said back surface and has a central axis that is substantially straight and substantially level, and wherein said slot extends through said main body between said bottom surface and said wire-receiving channel and is substantially straight and substantially perpendicular to said central axis.

10. An electrical connector assembly of claim 1, wherein said wire-receiving channel has a width to accommodate a plurality of stranded wires joined to each other to form a ribbon of wires, said wire-receiving channel being configured to center each wire of said ribbon to be generally aligned with another wire piercing portion of an associated electrical contact.

11. A method for interconnecting a printed circuit board and a wire comprising the steps of:

providing an electrical connector assembly including a main body having a wire-receiving channel therethrough for receiving an insulated stranded core wire, at least one generally transverse slot opening at only one side of said main body and extending to said wire-receiving channel, an opposite side to said one side being a generally smooth continuous surface, and an electrical contact having an end slideably received within said main body and adapted to pierce insulation on a wire extending through said wire-receiving channel and directly connect with strands of a wire inserted within said wire-receiving channel, said electrical contact having a free end adapted to be surface mounted on a printed circuit board:

surface mounting said electrical connector assembly on a printed circuit board (PCB) by soldering said free end to said PCB;

inserting a wire into said wire-receiving channel; and connecting said electrical contact with said wire by extending said electrical contact into said wire-receiving channel by sliding said main body along said electrical contact and piercing the insulation and stranded core of the wire.

12. The method of claim 11, wherein the step of attaching said electrical connector assembly to said printed circuit board includes placing said electrical connector assembly upon said printed circuit board using an automated pick-and-place machine.

13. The method of claim 12, wherein said step of placing said electrical connector assembly upon said printed circuit board using an automated pick-and-place machine includes picking up said electrical connector assembly using a vacuum nozzle that releasably holds a relatively broad and substantially flat portion of said electrical connector assembly.

14. The method of claim 11, wherein the step of attaching said electrical connector assembly on the printed circuit board includes reflow soldering said free lower end to a pad on said printed circuit board.

15. The method of claim 11, wherein the step of connecting said electrical contact with said wire includes piercing an amount of insulation material surrounding said wire and piercing the core strands in the wire.

16. The method of claim 11, wherein the step of connecting said electrical contact with said wire includes providing said electrical contact with at least one cutting portion having a substantially pointed shaped, and piercing an amount of said insulation material surrounding said wire.

17. An electrical connector system comprising:

a printed circuit board; and an electrical connector assembly including:

a main body having a wire-receiving channel therethrough for receiving an insulated stranded core wire, at least one generally transverse slot opening at only one side of said main body and extending to said wire-receiving channel an opposite side to said one side being a generally smooth continuous surface; and an electrical contact having an upper portion slideably received within a slot in said main body and having a wire piercing portion enter into said wire channel to pierce insulation on a wire extending through said wire-receiving channel and directly connect with strands of a wire inserted within said wire-receiving channel, and a free portion surface mounted on said printed circuit board, whereby an interconnection between said wire and said printed circuit board is formed after said electrical contact is attached to said printed circuit board and after said wire is inserted within said wire-receiving channel by a user sliding said main body along said electrical contact until said electrical contact extends into the strands forming the core of the wire within said wire-receiving channel and connects with said wire by piercing the insulation and stranded core of the wire.

18. A surface mount IDC connector for attaching wires to a printed circuit board, comprising a housing having a number of generally parallel wire-receiving channels at least equal to the number of wires to be connected and generally defining, when the connector is mounted on the printed circuit board (PCB), a plane substantially parallel to the surface of the PCB on which the connector is mounted, said wire-receiving channels being dimensioned to receive the wires with little clearance to thereby generally fix the physical positions of the wires against lateral or transverse shifting, said housing further including a number of slots corresponding to the number of said channels, each slot being substantially normal to said plane and aligned with and communicating with an associated channel; a plurality of piercing blade assemblies one received in each of said slots, each piercing blade assembly including at least one piercing blade receivable into the slot for movement through a slot and being at least partially receivable within an associated channel, said piercing blades having a length greater than the dimension of said slots in said normal direction and including a soldering portion positioned beyond said housing when said piercing blades are fully moved into said channels, whereby insertion of said piercing blades through the insulation of wires within said wire-receiving channels pierces the wires while leaving said soldering portions exposed outside said housing for surface mounting on a PCB.

19. A surface mount IDC of claim 18, wherein each piercing blade assembly includes a plurality of substantially co-planar piercing blades extending along the lengths of said wire-receiving channels, successive ones of said blades being offset to opposite sides of a plane defined by said co-planar piercing blades.

20. A surface mount IDC of claim 18, wherein each piercing blade assembly includes a plurality of substantially co-planar piercing blades and having a dimension substantially corresponding to the dimension of said slots along the direction of said wire-receiving channels, and including unidirectional material engaging means for engaging a material surface of said slots and permitting said piercing blade assemblies to be urged into said slots while preventing said piercing blade assemblies from being removed from said slots by providing significantly greater resistance of movement during insertion than during extraction or removal of said piercing blade assemblies.

* * * * *